US010417969B2

(12) United States Patent
Zhou et al.

(10) Patent No.: US 10,417,969 B2
(45) Date of Patent: Sep. 17, 2019

(54) ORGANIC LIGHT-EMITTING DIODE (OLED) DISPLAY PANEL, DRIVING METHOD THEREOF AND DISPLAY APPARATUS

(71) Applicant: Shanghai Tianma Micro-Electronics Co., Ltd., Shanghai (CN)

(72) Inventors: Xingyao Zhou, Shanghai (CN); Chuanli Leng, Shanghai (CN); Yuan Li, Shanghai (CN); Yana Gao, Shanghai (CN); Yue Li, Shanghai (CN); Renyuan Zhu, Shanghai (CN); Dongxu Xiang, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 30 days.

(21) Appl. No.: 15/865,762

(22) Filed: Jan. 9, 2018

(65) Prior Publication Data

US 2018/0130421 A1 May 10, 2018

(30) Foreign Application Priority Data

Sep. 8, 2017 (CN) ..... 2017 1 0807056

(51) Int. Cl.
*G09G 3/3266* (2016.01)

(52) U.S. Cl.
CPC ... *G09G 3/3266* (2013.01); *G09G 2300/0404* (2013.01); *G09G 2310/0221* (2013.01); *G09G 2320/0233* (2013.01); *G09G 2320/0257* (2013.01); *G09G 2320/0626* (2013.01)

(58) Field of Classification Search
CPC ..... G09G 3/3266; G09G 2320/0233; G09G 2320/0626; G09G 2310/0221
See application file for complete search history.

(56) References Cited

U.S. PATENT DOCUMENTS

2010/0231810 A1* 9/2010 Itoh ..... G09G 3/3666 348/731
2014/0085279 A1* 3/2014 Shiomi ..... G09G 3/2074 345/204
2015/0356925 A1* 12/2015 Lee ..... G09G 3/3266 345/212

* cited by examiner

*Primary Examiner* — Dennis P Joseph
(74) *Attorney, Agent, or Firm* — Anova Law Group, PLLC

(57) ABSTRACT

An organic light emitting (OLED) display panel, a driving method thereof, and a display apparatus are provided. The OLED display panel comprises a display region including N number of pixel rows and a non-display region including a light-emitting driver circuit and a scanning driver circuit. The display region includes a first display region including $N_1$ number of pixel rows and a second display region including $N_2$ number of pixel rows, where $N_1$, $N_2$, and N are positive integers, and $N_1+N_2=N$. A pixel row in the second display region has a smaller number of pixels than a pixel row in the first display region. The light-emitting driver circuit is configured to, in scanning time S for each frame, supply a light-emitting control signal having n number of light-emitting cycles to each pixel row in the display region, where n is a positive integer.

20 Claims, 17 Drawing Sheets

ORGANIC LIGHT-EMITTING DIODE (OLED) DISPLAY PANEL, DRIVING METHOD THEREOF AND DISPLAY APPARATUS

CROSS-REFERENCES TO RELATED APPLICATIONS

This application claims the priority of Chinese Patent Application No. 201710807056.1, filed on Sep. 8, 2017, the entire contents of which are incorporated herein by reference.

FIELD OF THE DISCLOSURE

The present disclosure generally relates to the field of display technology and, more particularly, relates to an organic light-emitting diode (OLED) display panel, a driving method thereof, and a display apparatus.

BACKGROUND

Organic light-emitting diode (OLED) display panels are display devices made of organic materials, which are featured with low operation voltage, fast response time, high light-emitting efficiency, wide viewing angle, and wide operating temperature range, etc. OLED display panels allow display devices to have a light and thin design, a low power consumption, and a curved surface.

Currently, OLED display panels are widely used in various display devices such as smart phones. To suppress image retention/image sticking without affecting the display brightness, a dimming mode is often used to drive the OLED display panels, such that a plurality of alternately dark and bright stripes continuously scroll downward in the display region of the OLED display panel.

The disclosed display panel, driving method thereof, and display apparatus are directed to solve one or more problems set forth above and other problems.

BRIEF SUMMARY OF THE DISCLOSURE

One aspect of the present disclosure provides an OLED display panel, comprising a display region including N number of pixel rows and a non-display region including a light-emitting driver circuit and a scanning driver circuit. The display region includes a first display region including $N_1$ number of pixel rows and a second display region including $N_2$ number of pixel rows, where $N_1$, $N_2$, and N are positive integers, and $N_1+N_2=N$. A pixel row in the second display region has a smaller number of pixels than a pixel row in the first display region. The light-emitting driver circuit is configured to, in scanning time S for each frame, supply a light-emitting control signal having n number of light-emitting cycles to each pixel row in the display region, where n is a positive integer. The scanning driver circuit is configured to, in the scanning time S for each frame, scan each pixel row in the display region. The $N_2$ number of pixel rows in the second display region and the scanning time S for each frame satisfies $$(k-0.1)\frac{S}{n} \le N_2 t \le (k+0.1)\frac{S}{n},$$

and $N_2$ t>0, where k is an integer greater than or equal to 0, and t is scanning time for the scanning driver circuit to scan one pixel row.

Another aspect of the present disclosure provides a display apparatus comprising a disclosed OLED display panel.

Another aspect of the present disclosure provides a driving method for an OLED display panel comprising: a display region including N number of pixel rows; and a non-display region including a light-emitting driver circuit and a scanning driver circuit. The display region includes a first display region including $N_1$ number of pixel rows and a second display region including $N_2$ number of pixel rows, where $N_1$, $N_2$, and N are positive integers, and $N_1+N_2=N$. A pixel row in the second display region has a smaller number of pixels than a pixel row in the first display region. The light-emitting driver circuit is configured to, in scanning time S for each frame, supply a light-emitting control signal having n number of light-emitting cycles to each pixel row in the display region, where n is a positive integer. The scanning driver circuit is configured to, in the scanning time S for each frame, scan each pixel row in the display region. The $N_2$ number of pixel rows in the second display region and scanning time S for each frame satisfies $$(k-0.1)\frac{S}{n} \le N_2 t \le (k+0.1)\frac{S}{n},$$

and $N_2$ t>0, where k is an integer greater than or equal to 0, and t is scanning time for the scanning driver circuit to scan one pixel row. The driving method comprises: in the scanning time S for each frame, supplying, by the light-emitting driver circuit, the light-emitting control signal having the n number of light-emitting cycles to each pixel row; and in the scanning time S for each frame, scanning, by the scanning driver circuit, each pixel row in the display region. The $N_2$ number of pixel rows in the second display region and the scanning time S for each frame satisfies $$(k-0.1)\frac{S}{n} \le N_2 t \le (k+0.1)\frac{S}{n},$$

and $N_2$ t>0, where k is an integer greater than or equal to 0, and t is the scanning time for the scanning driver circuit to scan one pixel row.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1A:
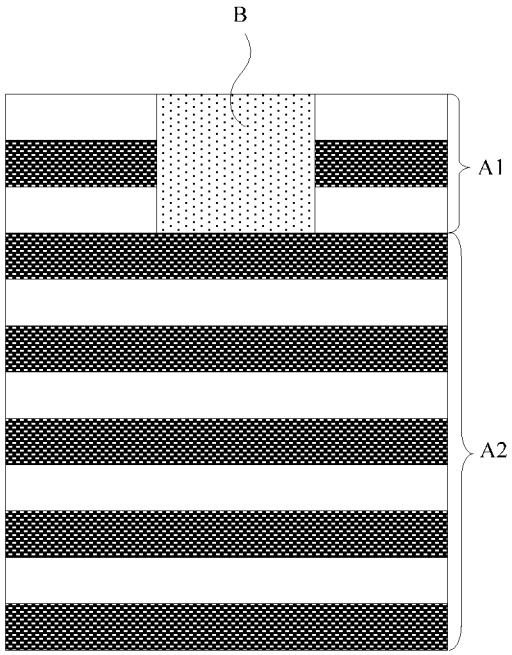
FIG. 1A (Prior Art)
FIG. 1A and FIG. 1B illustrate respective views of an existing OLED display panel operated in a dimming mode at different moments.

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiments, persons of ordinary skill in the art may derive other embodiments consistent with the present disclosure, all of which are within the scope of the present invention.

Further, the drawings are only used for illustrating the relative position relationship, and certain structures may be shown in a disproportional scale for the purpose of comprehension. The dimensions in the drawings do not represent the actual proportional relationship.

Figure 1B:
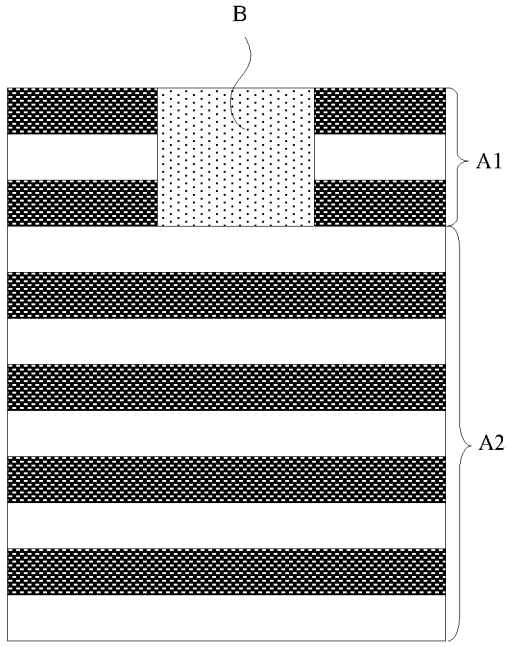
FIG. 1B (Prior Art)

FIG. 1A and FIG. 1B illustrate respective views of an existing OLED display panel operated in a dimming mode at different moments. As shown in FIG. 1A and FIG. 1B, the display panel may include a first display region A1 which contains an irregular region B, and a second display region A2 which does not contain any portion of the irregular-shaped region B. To achieve full-screen display in a smart phone, the camera, the microphone, and other appropriate components are often configured in an irregular-shaped region B of the display panel, such that a pixel row in the first display region A1 may include fewer number of pixels than a pixel row in the second display region A2.

After the display panel is turned on, when a plurality of alternate bright and dark stripes are continuously scrolling downward, the number of bright pixels in the entire display region may vary at different moments. For example, when the bright and dark stripes move to a position shown in FIG. 1A, the entire display region may include a minimum number of bright pixels. When the bright and dark stripes move to a position shown in FIG. 1B, the entire display region may include a maximum number of bright pixels. The varying number of the bright pixels at different moments may cause the power supply voltage (PVDD) to have different voltage drops across the OLED display panel and the subsequent uneven display issue.

Figure 2A:
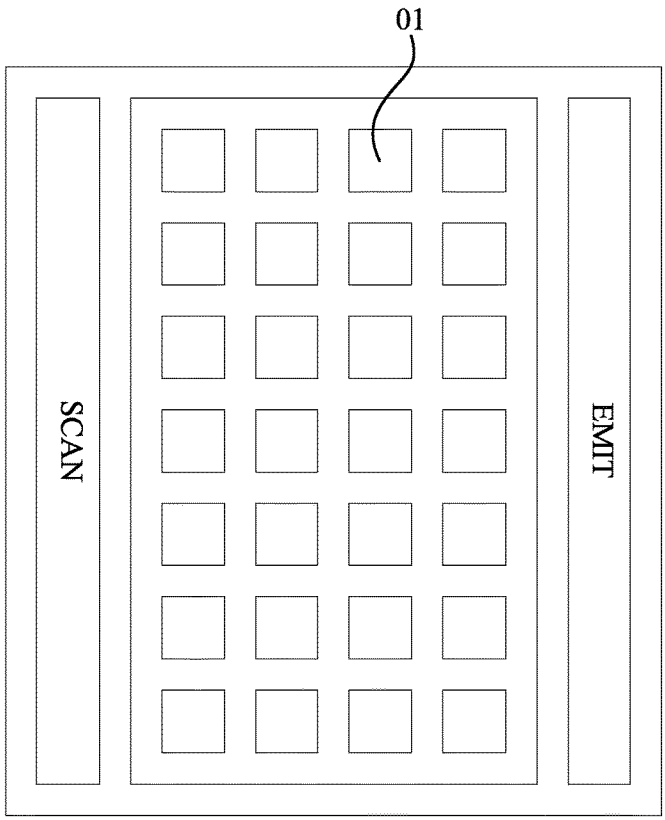
FIG. 2A (Prior Art)
FIG. 2A illustrates a schematic view of an existing OLED display panel.
Figure 2B:
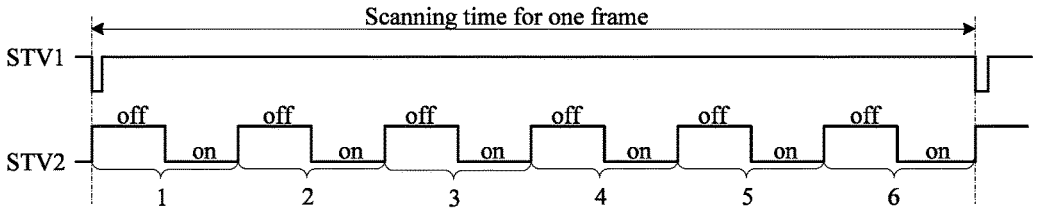
FIG. 2B (Prior Art)
FIG. 2B illustrates a signal timing diagram of a frame start signal in an existing driving method for an existing OLED display panel.

FIG. 2A illustrates a schematic view of an existing OLED display panel. FIG. 2B illustrates a signal timing diagram of a frame start signal in an existing driving method for an existing OLED display panel. As shown in FIG. 2A and FIG. 2B, when the existing OLED display panel is operated in the dimming mode, in scanning time/scanning period of each frame, a scanning driver circuit (SCAN) supplies a constant first frame start signal STV1 to allow the scanning driver circuit to sequentially supply a scanning signal to each row of pixels 01. A light-emitting driver circuit (EMIT) may supply a second frame start signal STV2 configured in a multi-pulse mode. That is, the second frame start signal STV2 may include a plurality of light-emitting cycles, for example, six light-emitting cycles as shown in FIG. 2B. The light-emitting cycle may include a high voltage signal portion h that controls the pixel 01 not to emit light and a low voltage signal portion 1 that controls the pixel 01 to emit light.

Figure 2C:
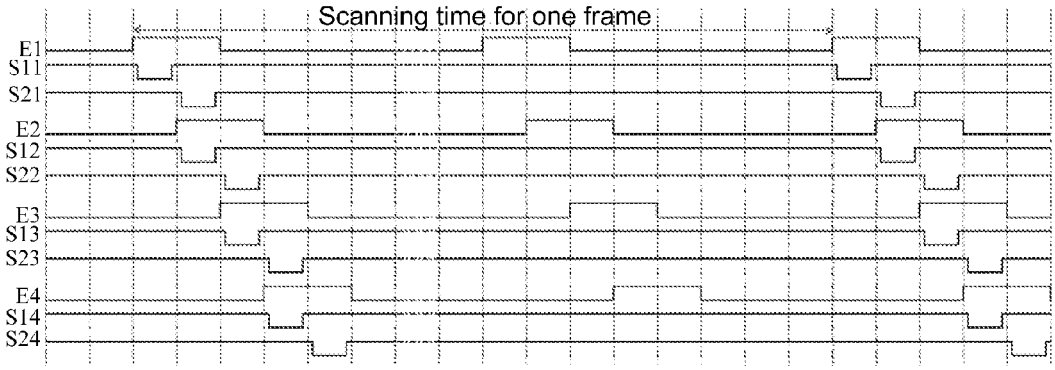
FIG. 2C (Prior Art)
FIG. 2C illustrates a signal timing diagram of signals in an existing driving method for an existing OLED display panel.

FIG. 2C illustrates a signal timing diagram of signals in an existing driving method for an existing OLED display panel. As shown in FIG. 2C, shift registers in the light-emitting driver circuit (EMIT) supply light-emitting control signals E1, E2, E3, and E4, each of which has the same light-emitting cycles as the second frame start signal STV2, to the corresponding pixels 01, such that under the control of the light-emitting control signals, the pixels 01 may periodically emit light in the scanning time of each frame.

Figure 2D:
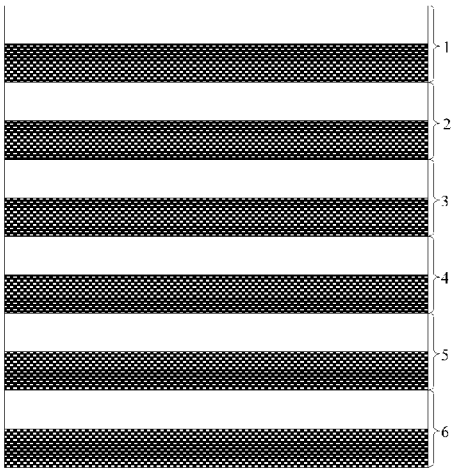
FIG. 2D (Prior Art)
FIG. 2D and FIG. 2E illustrate respective views of an existing OLED display panel operated in a dimming mode at different moments.
Figure 2E:
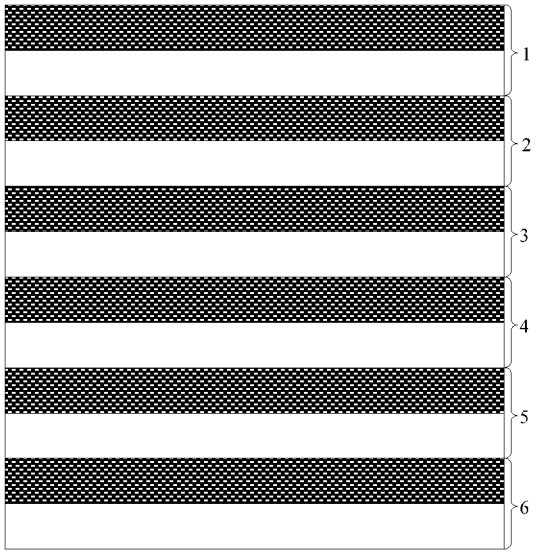
FIG. 2E (Prior Art)

Thus, in the dimming mode, a plurality of downward scrolling bright and dark stripes may appear in the display region of the OLED display panel. One bright stripe and one adjacent dark stripe may form a bright-dark-stripe cycle, which coincides with the light-emitting cycle of the second frame start signal STV2. FIG. 2D and FIG. 2E illustrate respective views of an existing OLED display panel operated in a dimming mode at different moments. As shown in FIG. 2D and FIG. 2E, the number of the minimum cycles may be equal to the number of light-emitting cycles of the second frame start signal STV2, and both of which are 6.

To achieve a full-screen display, the irregular-shaped region B is configured in the display region. On one hand, in the scanning time of one frame, when the bright and dark stripes move to the position shown in FIG. 1A, the entire display region may include the minimum number of bright pixels. Accordingly, the total current consumed in the display region may be reduced, the voltage drop of PVDD may be reduced, and the displayed image may appear substantially bright. On the other hand, in the scanning time of one frame, when the bright and dark stripes move to the position shown in FIG. 1B, the entire display region may include the maximum number of bright pixels. Accordingly, the total current consumed in the display region may be increased, the voltage drop of PVDD may be increased, and the displayed image may appear substantially dark.

In view of this, the present disclosure provides an OLED display panel, a driving method thereof, and a display apparatus for suppressing the bright-dark stripes and improving the display performance.

Figure 3:
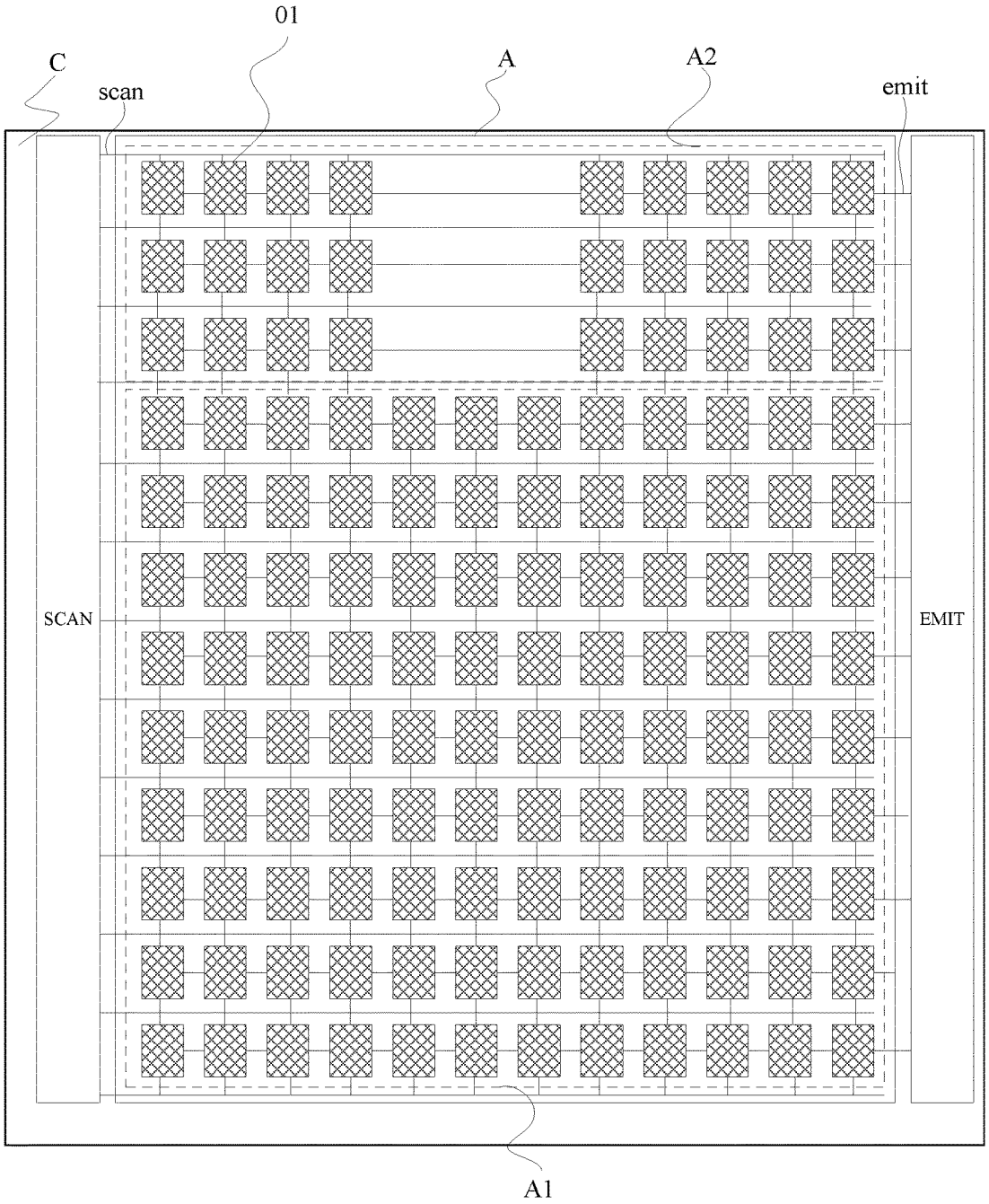
FIG. 3 illustrates a schematic view of an exemplary OLED display panel according to the disclosed embodiments.

FIG. 3 illustrates a schematic view of an exemplary OLED display panel according to the disclosed embodiments. As shown in FIG. 3, the OLED display panel may include a display region A and a non-display region C. The display region A may include N rows of pixels 01, i.e., N pixel rows. The non-display region C may include a light-emitting driver circuit EMIT and a scanning driver circuit SCAN. The display region A may include a first display region A1 and a second display region A2, the first display region A1 may include $N_1$ row of pixels 01, and the second display region A2 may include $N_2$ rows of pixels 01, where N, $N_1$, and $N_2$ are positive integers, and $N_1+N_2=N$. A pixel row in the second display region A2 may include fewer pixels 01 than a pixel row in the first display region A1.

In the scanning time of each frame, the light-emitting driver circuit EMIT may be configured to supply a light-emitting control signal having n light-emitting cycles to each row of the pixels 01, where n is a positive integer. In the scanning time of each frame, the scanning driver circuit SCAN may be configured to scan each row of pixels 01 in the display region A. The $N_2$ number of pixel rows in the second display region A2 and the scanning time S for one frame may satisfy the following equation:

$$(k-0.1)\frac{S}{n} \le N_2 t \le (k+0.1)\frac{S}{n}, \text{ and } N_2 t > 0$$

where k is an integer greater than or equal to 0, n is the number of light-emitting cycles of the light-emitting control signal which is supplied to each row of the pixels in the scanning time of each frame, and t is the time for the scanning driver circuit SCAN to scan one row of pixels.

When operated in the dimming mode, the disclosed OLED display panel may have continuously downward scrolling bright and dark stripes in the display region. One light stripe and one dark stripe together may form a bright-dark-stripe cycle, which coincides with one light-emitting cycle of the light-emitting control signal. In particular, the number of the pixel rows in one bright-dark-stripe cycle may be S/nt. In the disclosed OLED display panel, the number of the pixel rows in the second display region A2 may be configured to be approximately an integer multiple of the number of the pixel rows in one bright-dark-stripe cycle, i.e., $$(k-0.1)\frac{S}{n} \le N_2 t \le (k+0.1)\frac{S}{n}, \text{ and } N_2 t > 0$$

where k is an integer greater than or equal to 0, n is the number of light-emitting cycles of the light-emitting control signal which is provided to each row of the pixels 01 in the scanning time of each frame, and t is the time for the scanning driver circuit to scan one row of pixels.

Thus, although the bright and dark stripes are continuously scrolling downward, the maximum number of the bright pixels in the second display region may be close to the minimum number of the bright pixels in the second the display region, and the total current consumed in the second display region may substantially remain the same. Thus, the different voltage drops in the PVDD, which is caused by the substantial number difference between the bright pixels in the second display region at different moments, may be reduced, and the uneven display issue may be resolved.

In one embodiment, as shown in FIG. 3, the light-emitting driver circuit EMIT may supply the light-emitting control signal to each row of the pixels 01 through a corresponding light-emitting control signal line (emit). The scanning driver circuit SCAN may supply the scanning signal to each row of the pixels 01 through a corresponding scanning signal line (scan).

In the disclosed OLED display panel, the pixel may include a pixel circuit and a light-emitting diode corresponding to the pixel circuit, and one pixel circuit may correspond to one light-emitting diode in one pixel, which is for illustrative purposes and is not intended to limit scope of the present disclosure. In practical applications, one pixel circuit may correspond to more than one light-emitting diode, which may be determined according to various application scansions and is not limited by the present disclosure.

In one embodiment, one pixel circuit may include a switching transistor and a driving transistor. An output terminal of the switching transistor may be electrically connected to a gate electrode of the driving transistor, and an output terminal of the driving transistor may be electrically connected to the light-emitting diode.

Figure 11:
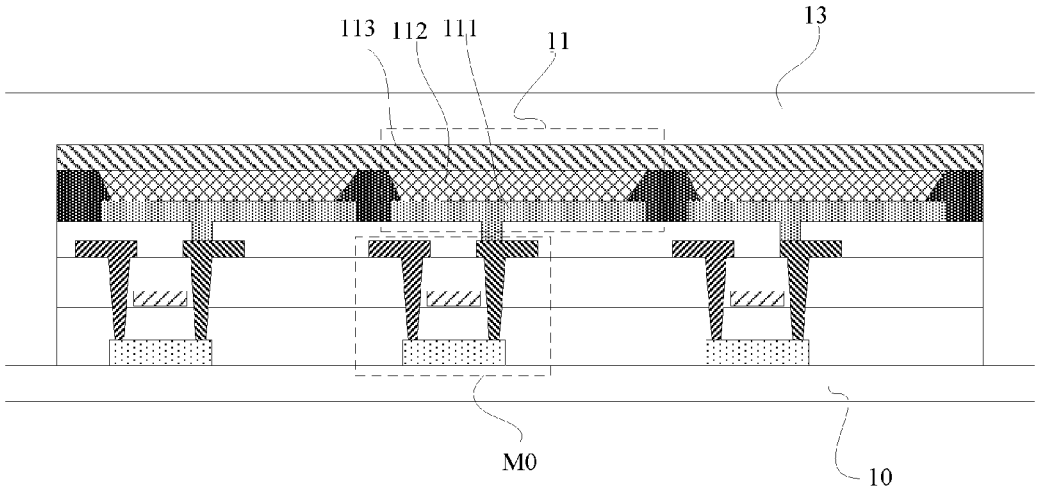
FIG. 11 illustrates a cross-sectional view of an exemplary OLED display panel according to the disclosed embodiments.

FIG. 11 illustrates a cross-sectional view of an exemplary OLED display panel according to the disclosed embodiments. As shown in FIG. 11, the OLED display panel may include a substrate 10, a pixel circuit (only the driving transistor M0 is drawn in FIG. 11) disposed on the substrate 10, a light-emitting diode 11 electrically connected to the driving transistor M0, and an encapsulation layer 13 for encapsulation. The light-emitting diode 11 may include an anode 111, a cathode 113, and an organic light-emitting layer 112 disposed between the anode 111 and the cathode 113.

Figure 4A:
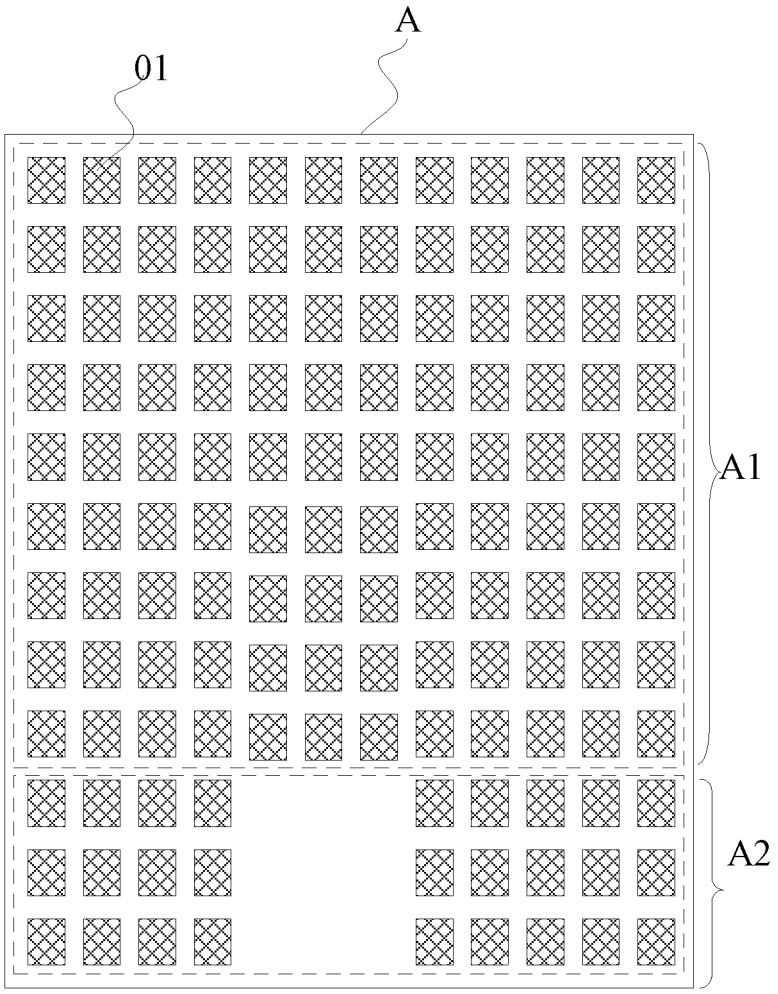
FIG. 4A illustrates a schematic view of another exemplary OLED display panel according to the disclosed embodiments.
Figure 4B:
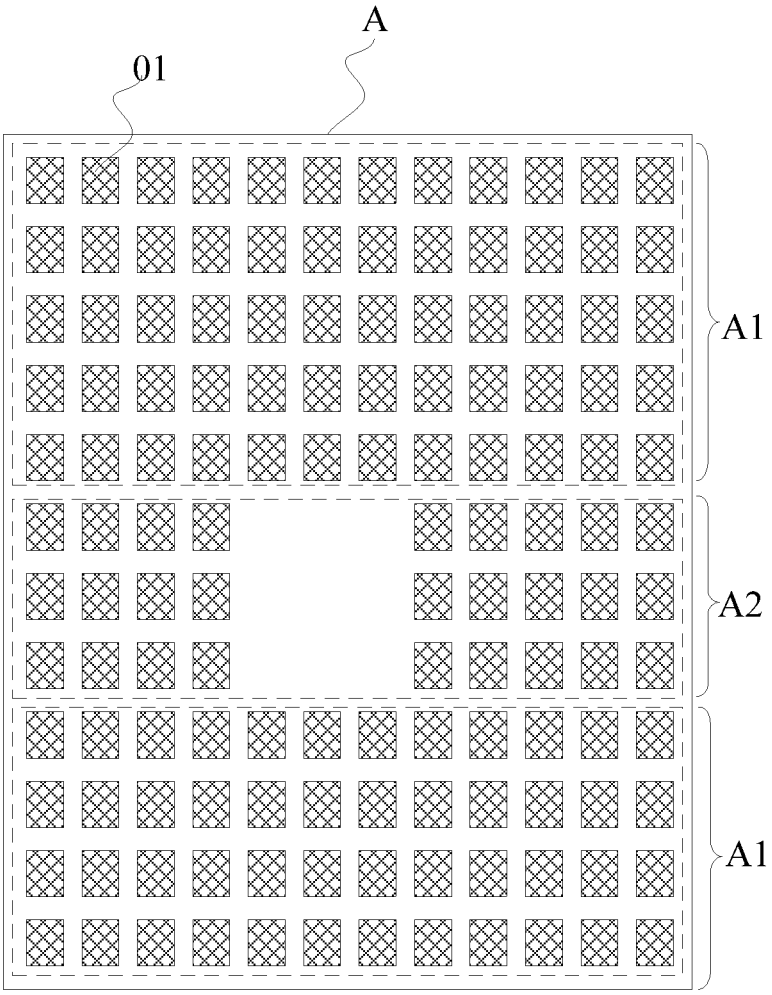
FIG. 4B illustrates a schematic view of another exemplary OLED display panel according to the disclosed embodiments.

In one embodiment, as shown in FIG. 3, the second display region A2 may be disposed on top of the first display region A1 (A2 and A1 are in the same surface plane). In another embodiment, as shown in FIG. 4A, the second display region A2 may be disposed at bottom of the first display region A1. In another embodiment, as shown in FIG. 4B, the second display region A2 may be disposed inside the first display region A1. In practical applications, the location of the second display region A2 may be determined according to various application scenarios, which is not limited by the present disclosure.

Figure 5A:
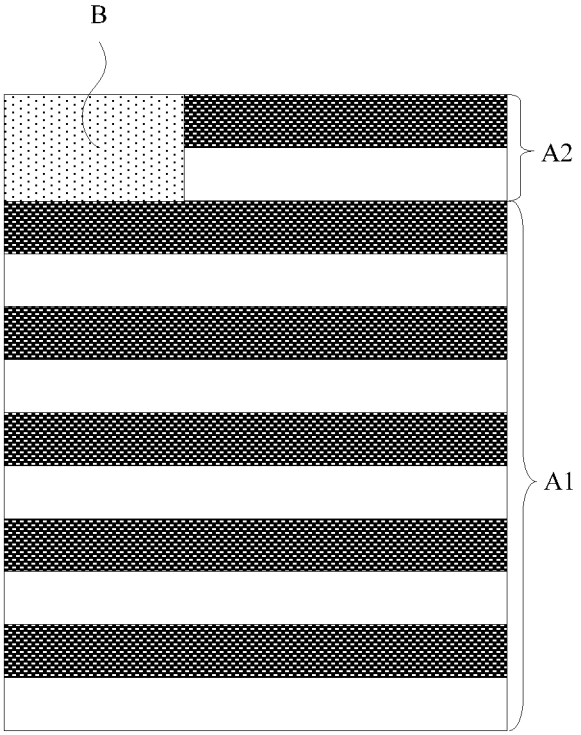
FIG. 5A illustrates a schematic view of another exemplary OLED display panel according to the disclosed embodiments.
Figure 5B:
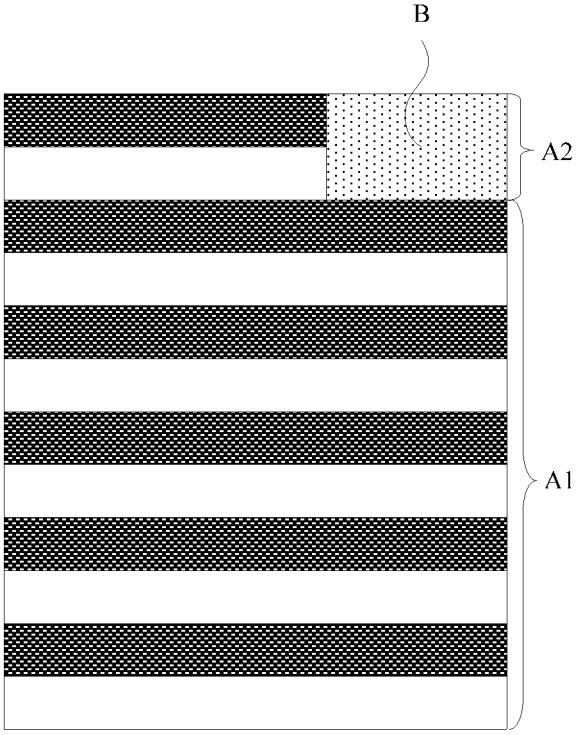
FIG. 5B illustrates a schematic view of another exemplary OLED display panel according to the disclosed embodiments.
Figure 5C:
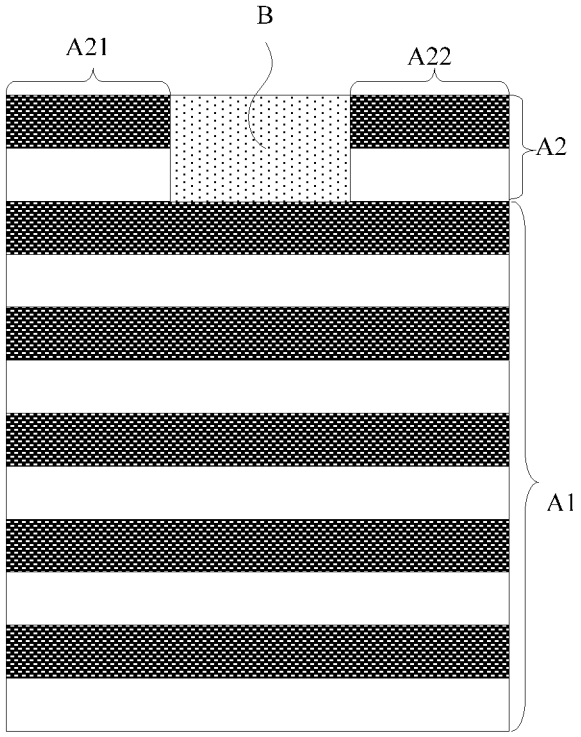
FIG. 5C illustrates a schematic view of another exemplary OLED display panel according to the disclosed embodiments.

In the disclosed embodiments, the OLED display panel may further include an irregular-shaped region B. In one embodiment, as shown in FIG. 5A, the irregular-shaped region B may be disposed in the upper left corner of the second display region A2. In another embodiment, as shown in FIG. 5B, the irregular-shaped region B may be disposed in the upper right corner of the second display region A2, which is for illustrative purposes and is not intended to limit the scope of the present disclosure. In practical applications, the location of the irregular-shaped region B may be determined according to various application scenarios, which is not limited by the present disclosure Further, in one embodiment, as shown in FIG. 5C, the second display region A2 may include a first sub-region A21 and a second sub-region A22. In each pixel row (specific pixel structure is not drawn in FIG. 5C) in the second display region A2, a certain number of the pixels may be disposed in the first sub-region A21, and the remained pixels may be disposed in the second sub-region A22. The first sub-region A21 and the second sub-region A22 may be separated by the irregular-shaped region B.

In particular, when the OLED display panel is implemented into a smart phone, the irregular-shaped region may often be configured with one or more of a camera, a microphone, an optical sensor, a distance sensor, an iris recognition sensor, and a fingerprint recognition sensor, which is for illustrative purposes and is not intended to limit the scope of the present disclosure. The irregular-shaped region may also be configured as a transparent display region, which is not limited by the present disclosure.

In one embodiment, as shown in FIG. 5C, to achieve a desired visual appearance, the first sub-region A21 and the second sub-region A22 may be configured symmetrically.

Figure 5D:
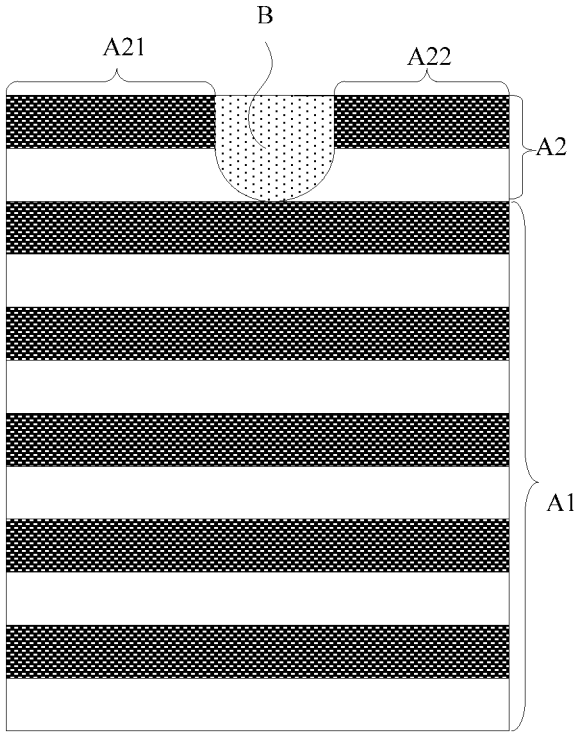
FIG. 5D illustrates a schematic view of another exemplary OLED display panel according to the disclosed embodiments.

In particular, the shape of the irregular-shaped region B may be determined by the shape of the device configured in the irregular-shaped region B. In one embodiment, when multiple devices are configured in the irregular-shaped region B, the irregular-shaped region B may have a rectangular shape as shown in FIG. 5C. In another embodiment, when the contour of the device configured in the irregular-shaped region B includes an arc, such as a circular camera as shown in FIG. 5D, the contour of the irregular-shaped region B may be an arc, which is for illustrative purposes and is not intended to limit the scope of the present disclosure.

In the disclosed OLED display panel, through configuring the number N of rows of the pixels in the second display region to satisfy the equation $$(k-0.1)\frac{S}{n} \le N_2 t \le (k+0.1)\frac{S}{n},$$

the uneven/non-uniform display in the dimming mode may be suppressed. Certain embodiments will be provided in the following for more details.

In one embodiment, when k=0, the number of the pixel rows in the second display region may satisfy the equation $$N_2 t \le 0.1\frac{S}{n}.$$

Figure 6A:
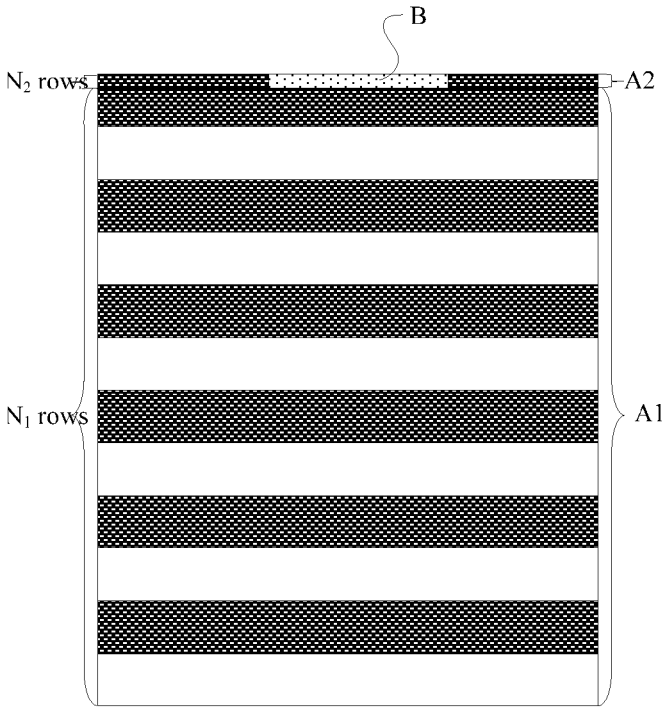
FIG. 6A and FIG. 6B illustrate respective views of an exemplary OLED display panel at different moments according to the disclosed embodiments.
Figure 6B:
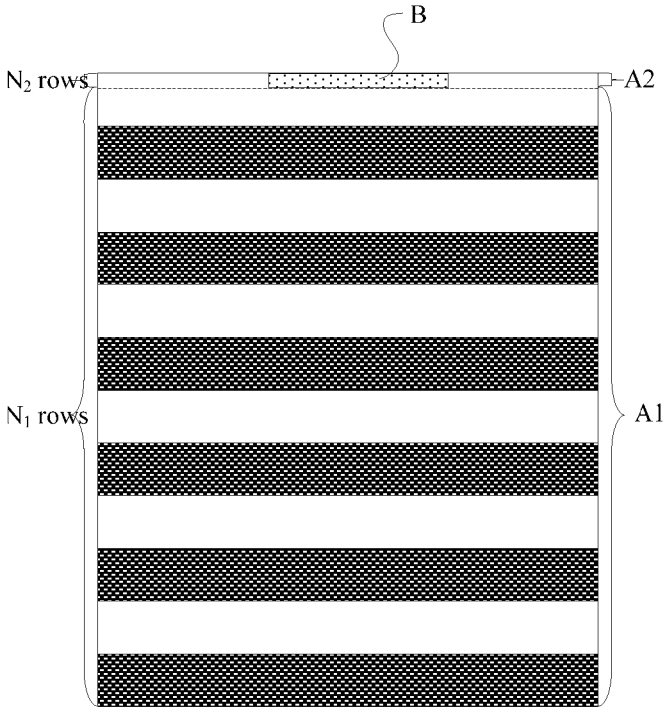

In particular, when $N_2t$=0.1 s/n, FIG. 6A illustrates a scenario where the number of bright pixel rows in the second display region reaches the maximum, and FIG. 6B illustrates a scenario where the number of bright pixel rows in the second display region reaches the minimum. Comparing FIG. 6A with FIG. 6B and comparing the maximum number of the bright pixels with the minimum number of the bright pixels in the display region A, the difference between the maximum number of the bright pixels and the minimum number of the bright pixels in the display region A may be smaller than one tenth of the number of the pixels included in one bright-dark-stripe cycle, i.e., the difference between the maximum number of the bright pixels and the minimum number of the bright pixels in the display region A may be substantially small. Further, when $$N_2 t < 0.1\frac{S}{n},$$

N may be substantially small, the difference between the maximum number of the bright pixels and the minimum number of the bright pixels in the display region A may be substantially small, and the PVDD voltage drop may substantially remain the same.

In the disclosed embodiments, when k>0, the number of the pixel rows in the second display region may satisfy the equation $$(k-0.1)\frac{S}{n} \le N_2 t \le (k+0.1)\frac{S}{n}.$$

Taking k=1 as an example, when $$N_2 = (1-0.1)\frac{S}{n},$$

Figure 7A:
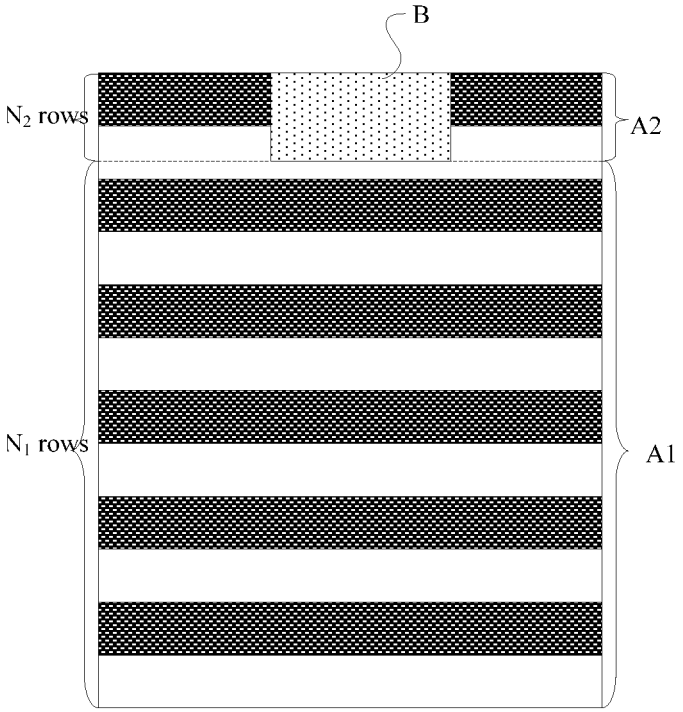
FIG. 7A and FIG. 7B illustrate respective views of another exemplary OLED display panel at different moments according to the disclosed embodiments.
Figure 7B:
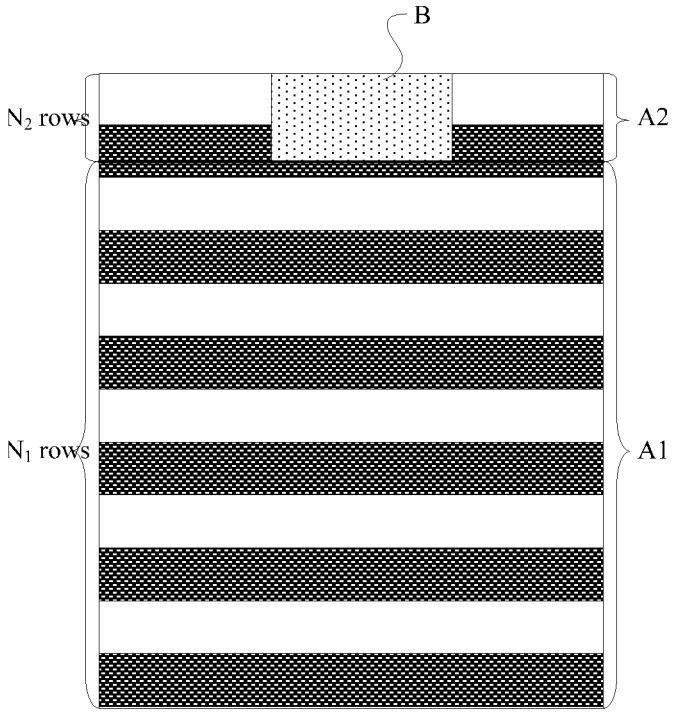

FIG. 7A illustrates a scenario where the number of bright pixel rows in the second display region reaches the maximum, and FIG. 7B illustrates a scenario where the number of bright pixel rows in the second display region reaches the minimum. Comparing FIG. 7A with FIG. 7B and comparing the maximum number of the bright pixels with the minimum number of the bright pixels in the display region A, the difference between the maximum number of the bright pixels and the minimum number of the bright pixels in the display region A may be smaller than one tenth of the number of the pixels included in one bright-dark-stripe cycle, i.e., the difference between the maximum number of the bright pixels and the minimum number of the bright pixels in the display region A may be substantially small.

Accordingly, when $$N_2 = (1+0.1)\frac{S}{n},$$

Figure 8A:
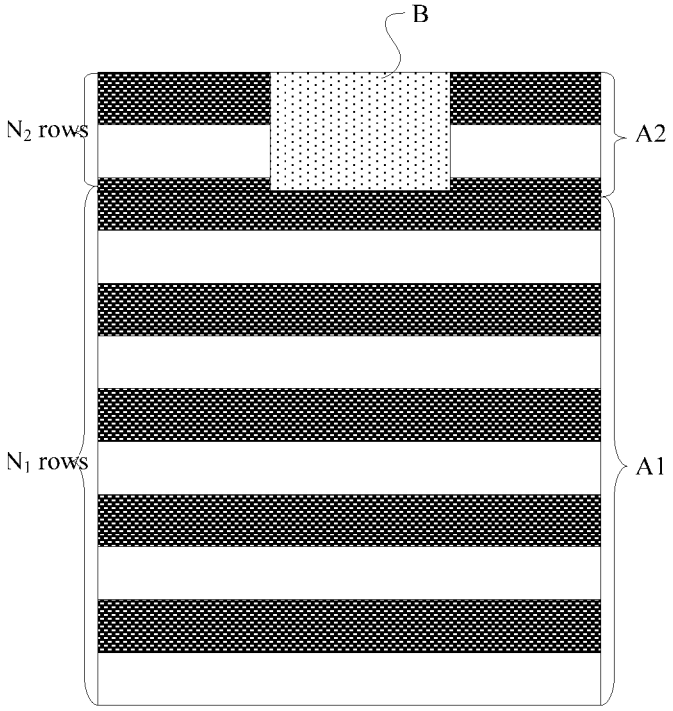
FIG. 8A and FIG. 8B illustrate respective views of another exemplary OLED display panel at different moments according to the disclosed embodiments.
Figure 8B:
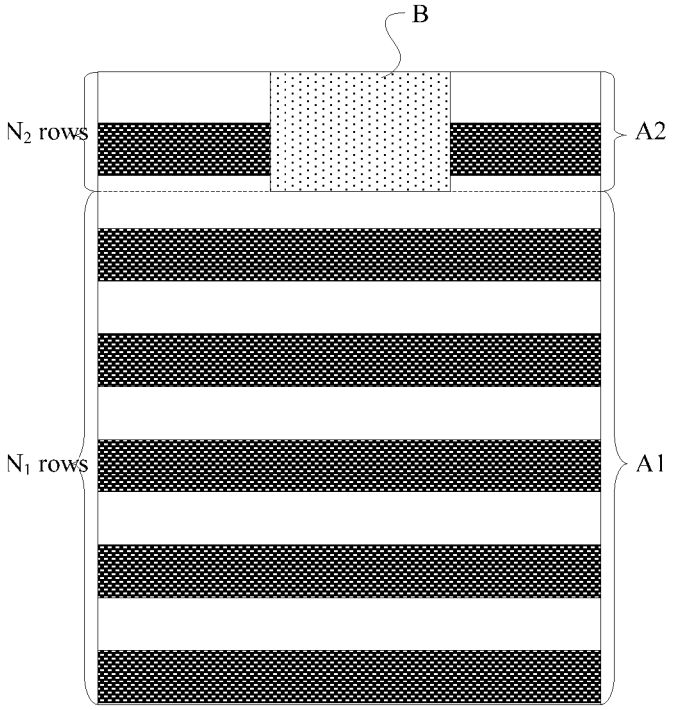

FIG. 8A illustrates a scenario where the number of bright pixel rows in the second display region reaches the maximum, and FIG. 8B illustrates a scenario where the number of bright pixel rows in the second display region reaches the minimum. Comparing FIG. 8A with FIG. 8B and comparing the maximum number of the bright pixels with the minimum number of the bright pixels in the display region A, the difference between the maximum number of the bright pixels and the minimum number of the bright pixels in the display region A may be smaller than one tenth of the number of the pixels included in one bright-dark-stripe cycle, i.e., the difference between the maximum number of the bright pixels and the minimum number of the bright pixels in the display region A may be substantially small.

Thus, in the disclosed OLED display panel, when $N_2$ is close to an integer multiple of the bright-dark-stripe cycle, the total current difference may be substantially small, and the PVDD voltage drop may substantially remain the same.

In one embodiment, when the number of pixel rows in the second display region satisfies the equation $$(k-0.1)\frac{S}{n} \le N_2 t \le (k+0.1)\frac{S}{n},$$

$N_2$ may be an integer approximately between 80 and 220.

In one embodiment, in the signal timing sequence of the OLED display panel, in addition to the normal display time (corresponding to the display region scanning time), the scanning time for each frame may further include front porch time/front porch period and back porch time/back porch time. The driver circuit (IC) may be adjusted during the front porch time and the back porch time.

In one embodiment, the scanning time for one frame S may include the front porch time, the display region scanning time, and the back porch time. The scanning time for N number of pixel rows may be Nt, where t is the time for the scanning driver circuit SCAN to scan one pixel row. The front porch time and the back porch time for M number of pixel rows maybe Mt, and S=t(N+M). During the display region scanning time, each pixel row in the display region of the OLED display panel may be scanned. During the front porch time and the back porch time, the driver circuit (IC) may be adjusted.

In one embodiment, to configure an equal number of pixel rows in each bright-dark-stripe cycle, (N+M)/n may be configured to be an integer.

Figure 9:
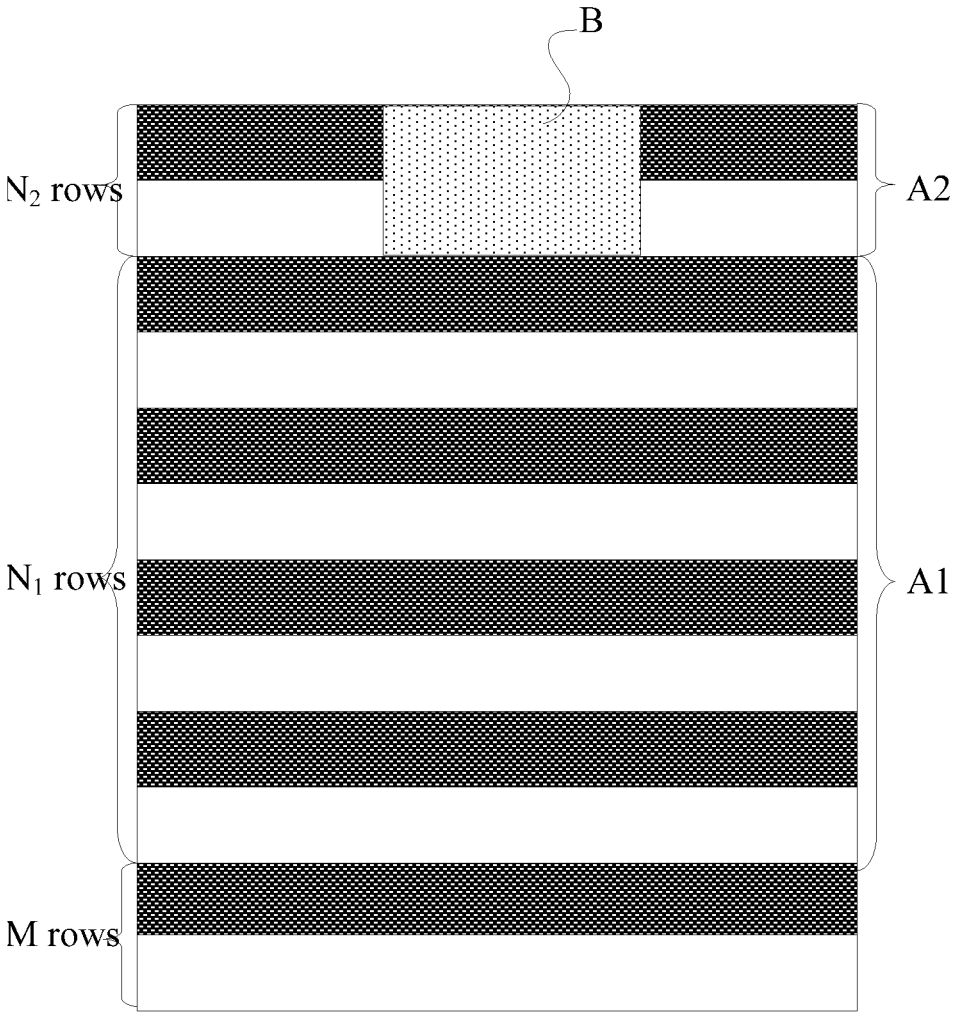
FIG. 9 illustrates a number of pixel rows in an exemplary second display region of an exemplary OLED display panel after front porch time and back porch time are added according to the disclosed embodiments.
Figure 10A:
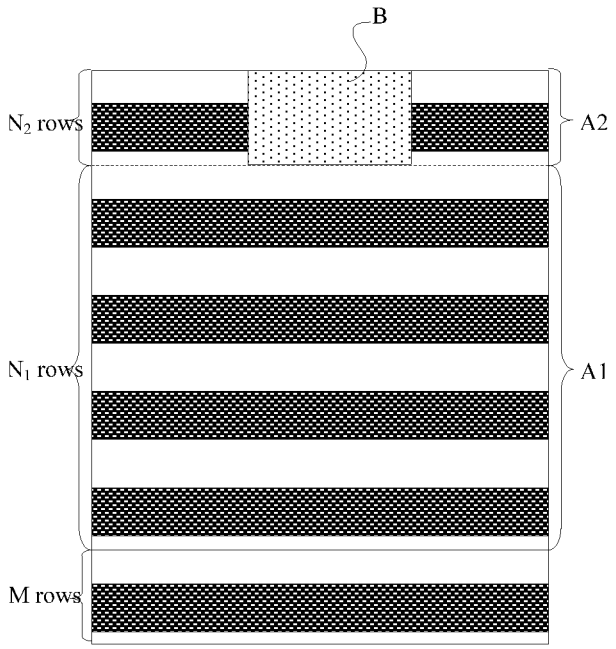
FIGS. 10A-10D illustrate various views of an exemplary OLED display panel at different moments according to the disclosed embodiments.
Figure 10B:
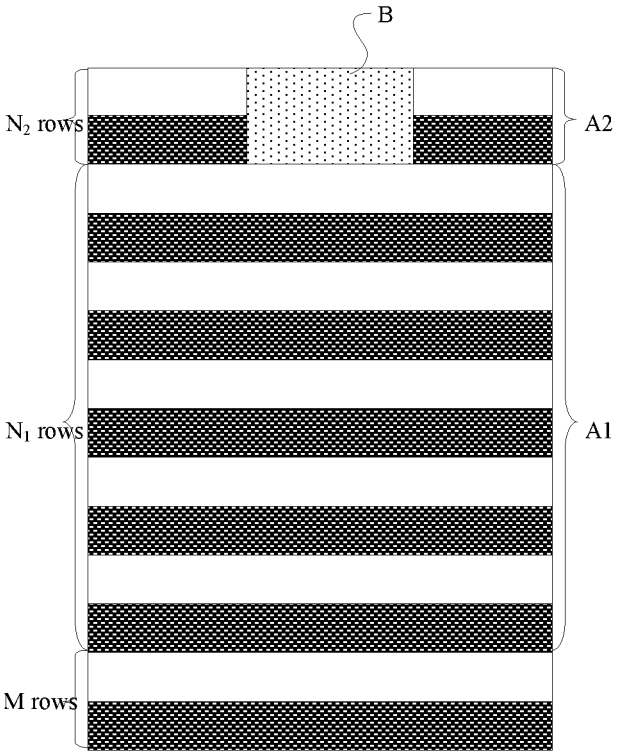
Figure 10C:
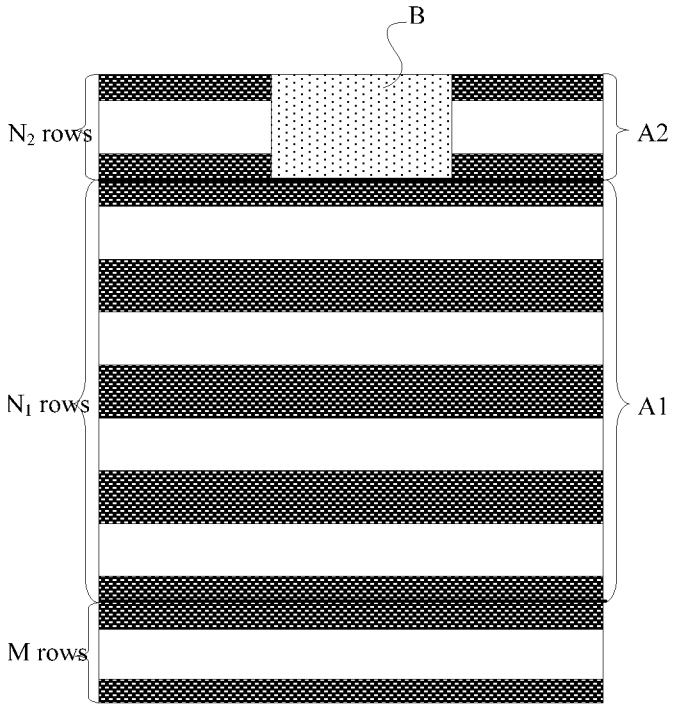
Figure 10D:
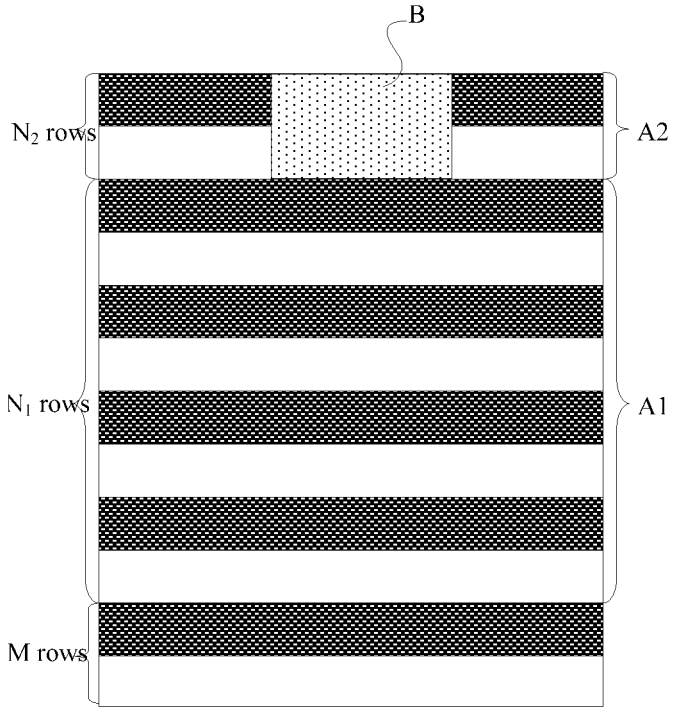

FIG. 9 illustrates a number of pixel rows in an exemplary second display region of an exemplary OLED display panel after the front porch time and the back porch time are added according to the disclosed embodiments. As shown in FIG. 9, to resolve the uneven display issue caused by the second display region, $$N_2 = k\frac{(N+M)}{n}.$$

That is, the number $N_2$ of pixel rows in the second display region A2 may be an integer multiple of the bright-dark-stripe cycle. Thus, at any time, the number of light stripes may be equal to the number of dark strips in the second display region A2, i.e., the number of bright pixel rows may be equal to the number of dark pixel rows in the second display region A2.

In particular, as shown in FIG. 9, when the scanning time for each frame includes the front porch time and the back porch time in addition to the normal display time, the presence of the front porch time and the back porch time may also cause the uneven display. In the disclosed OLED display panel as shown in FIGS. 10A-10D, $$M = m\frac{(N+M)}{n},$$

where m is an integer greater than 0. That is, the front porch time and the back porch time Mt may be equal to an integer multiple of the scanning time for one bright-dark-stripe cycle. Thus, at any time, the number of bright stripes may be equal to the number of dark stripes during the front porch time and the back porch time. The number of bright and dark stripes remained in the display region may be an integer multiple of one bright-dark-stripe cycle. Thus, the uneven display issue during the front porch time and the back porch time may be resolved.

In one embodiment, the OLED display panel has touch-control function. To avoid interference between the touch-control function and the display function, M may be configured to be an integer approximately between 280 and 320. For example, M may be equal to 280, 300, or 320, which are for illustrative purposes and are not intended to limit the scope of the present disclosure. Thus, the touch-control function may be performed during the front porch time and the back porch time.

In another embodiment, the OLED display panel does not have touch-control function. M may be configured to be an integer approximately between 10 and 20. For example, M may be equal to 10, 15, or 20, which are for illustrative purposes and are not intended to limit the scope of the present disclosure.

Figure 12:
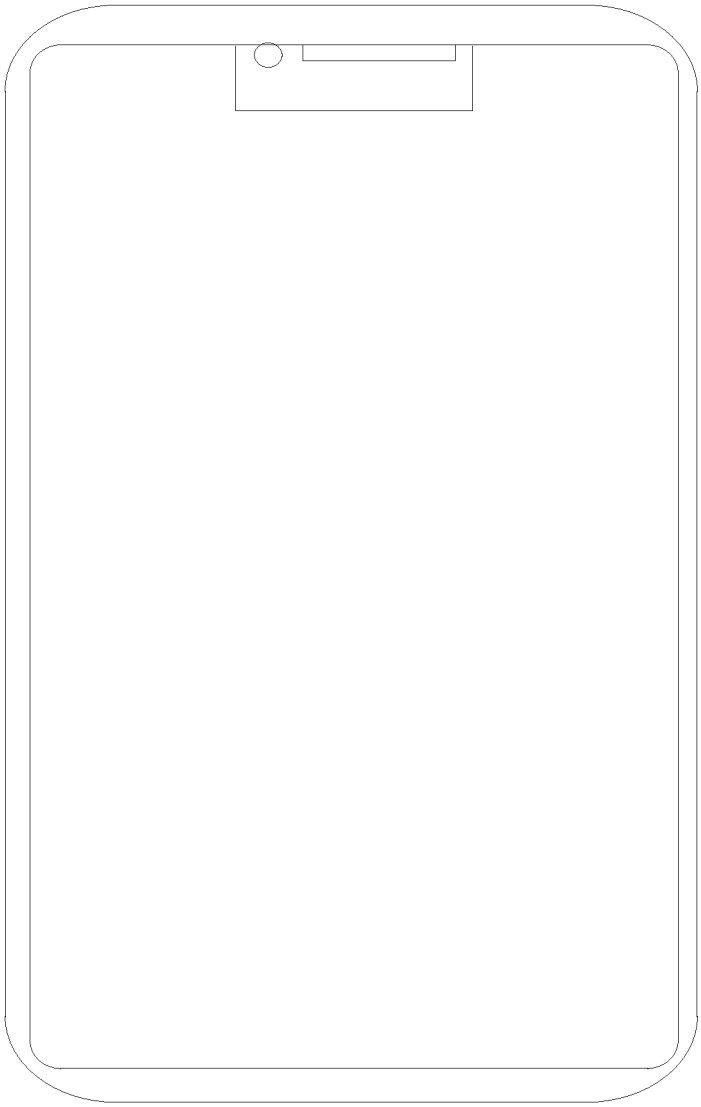
FIG. 12 illustrates a schematic view of an exemplary display apparatus according to the disclosed embodiments.

The present disclosure also provides a display apparatus. FIG. 12 illustrates a schematic view of an exemplary display apparatus according to the disclosed embodiments. As shown in FIG. 12, the display apparatus may include a disclosed OLED display panel. The display apparatus may be a smart phone, a tablet computer, a television set, a display, a laptop computer, a digital picture frame, a GPS, or other electronic devices having display function. The display apparatus may include other essential components, which are known to those skilled in the art, will not be described herein, and will not limit the scope of the present disclosure. The display apparatus may include the features and functions of the disclosed OLED display panel. The description of the embodiments of the display apparatus may refer to the embodiments of the OLED display panel, and will not be repeated herein.

The present disclosure also provides a driving method for the disclosed OLED display panel. The driving method may include the following steps. In a scanning time S for each frame, a light-emitting driver circuit may supply a light-emitting control signal having n number of light-emitting cycles to each pixel row, and a scanning driver circuit may scan each pixel row in the display region. $N_2$ number of pixel rows in a second display region containing an irregular-shaped region and the scanning time S for one frame may satisfy the equation:

$$(k-0.1)\frac{S}{n} \le N_2 t \le (k+0.1)\frac{S}{n}, \text{ and } N_2 t > 0$$

where k is an integer greater than or equal to 0, n is the number of light-emitting cycles of the light-emitting control signal which is provided to each row of the pixels in the scanning time of each frame, and t is the time for the scanning driver circuit to scan one row of pixels.

In one embodiment, the scanning time S for one frame may include a display region scanning time, a front porch time, and a back porch time. The display region scanning time for scanning N number of the pixel rows may be Nt. The front porch time and the back porch time for M number of the pixel rows may be Mt, and S=t(N+M).

In one embodiment, (N+M)/n may be a positive integer.

In one embodiment.

$$N_2 = k\frac{(N+M)}{n}.$$

In one embodiment, $$M = m\frac{(N+M)}{n},$$

where m is an integer greater than 0.

The present disclosure provides an OLED display panel, a driving method for the disclosed OLED display panel, and a display apparatus. The $N_2$ number of the pixel rows in the second display region may be configured to be approximately an integer multiple of the number of pixel rows in one bright-dark-stripe cycle, i.e., $$(k-0.1)\frac{S}{n} \le N_2 t \le (k+0.1)\frac{S}{n}, \text{ and } N_2 t > 0$$

where k is an integer greater than or equal to 0, n is the number of light-emitting cycles of the light-emitting control signal which is provided to each row of the pixels in the scanning time of each frame, and t is the time for the scanning driver circuit to scan one row of pixels.

Thus, although the bright and dark stripes are continuously scrolling downward, the maximum number of the bright pixels in the second display region may be close to the minimum number of the bright pixels in the second the display region, and the total current consumed in the second display region may remain substantially the same. Thus, the different voltage drop in the PVDD, which is caused by the substantial number difference between the bright pixels in the second display region at different moments, may be reduced, and the uneven display issue may be resolved.

Various embodiments have been described to illustrate the operation principles and exemplary implementations. It should be understood by those skilled in the art that the present disclosure is not limited to the specific embodiments described herein and that various other obvious changes, rearrangements, and substitutions will occur to those skilled in the art without departing from the scope of the disclosure. Thus, while the present disclosure has been described in detail with reference to the above described embodiments, the present disclosure is not limited to the above described embodiments, but may be embodied in other equivalent forms without departing from the scope of the present disclosure, which is determined by the appended claims.

What is claimed is:

1. An organic light-emitting diode (OLED) display panel, comprising:

a display region including N number of pixel rows; and a non-display region including a light-emitting driver circuit and a scanning driver circuit, wherein:

the display region includes a first display region including $N_1$ number of pixel rows and a second display region including $N_2$ number of pixel rows, where $N_1$, $N_2$, and N are positive integers, and $N_1+N_2=N$;

a pixel row in the second display region has a smaller number of pixels than a pixel row in the first display region;

the light-emitting driver circuit is configured to, in scanning time S for each frame, supply a light-emitting control signal having n number of light-emitting cycles to each pixel row in the display region, where n is a positive integer;

the scanning driver circuit is configured to, in the scanning time S for each frame, scan each pixel row in the display region; and the $N_2$ number of pixel rows in the second display region and the scanning time S for each frame satisfies $$(k-0.1)\frac{S}{n} \le N_2 t \le (k+0.1)\frac{S}{n},$$

and $N_2$ t>0, where k is an integer greater than or equal to 0, and t is scanning time for the scanning driver circuit to scan one pixel row.

2. The OLED display panel according to claim 1, wherein:

$N_2$ is an integer between 80 and 220.

3. The OLED display panel according to claim 1, wherein:

the scanning time S for each frame includes display region scanning time, front porch time, and back porch time;

the display region scanning time for the N number of pixel rows is Nt;

the front porch time and the back porch time for M number of pixel rows are Mt; and S=t(N+M).

4. The OLED display panel according to claim 3, wherein:

$$N_2 = k\frac{(N+M)}{n}.$$

5. The OLED display panel according to claim 3, wherein:

$$M = m\frac{(N+M)}{n},$$

where m is an integer greater than 0.

6. The OLED display panel according to claim 3, wherein:

M is an integer between 10 and 20.

7. The OLED display panel according to claim 3, wherein:

M is an integer between 280 and 320.

8. The OLED display panel according to claim 1, wherein:

the second display region is disposed above or below the first display region, and the second display region and the first display region are arranged in a same plane;

the second display region includes a first sub-region and a second sub-region;

a certain number of pixels in each pixel row are disposed in the first sub-region, and remained pixels in the same pixel row in the second display region are disposed in the second sub-region;

the OLED display panel includes an irregular-shaped region; and the first sub-region and the second sub-region are separated by the irregular-shaped region.

9. The OLED display panel according to claim 8, wherein:

a contour of the irregular-shaped region is an arc.

10. The OLED display panel according to claim 8, wherein:

the irregular-shaped region is a transparent display region.

11. The OLED display panel according to claim 8, wherein:

the irregular-shaped region is configured with one or more of a camera, a microphone, an optical sensor, a distance sensor, an iris recognition sensor, and a fingerprint recognition sensor.

12. The OLED display panel according to claim 8, wherein:

the first sub-region and the second sub-region are configured symmetrically.

13. A display apparatus, comprising an OLED display panel, wherein the OLED display panel comprises:

a display region including N number of pixel rows; and a non-display region including a light-emitting driver circuit and a scanning driver circuit, wherein:

the display region includes a first display region including $N_1$ number of pixel rows and a second display region including $N_2$ number of pixel rows, where $N_1$, $N_2$, and N are positive integers, and $N_1+N_2=N$;

a pixel row in the second display region has a smaller number of pixels than a pixel row in the first display region;

the light-emitting driver circuit is configured to, in scanning time S for each frame, supply a light-emitting control signal having n number of light-emitting cycles to each pixel row in the display region, where n is a positive integer;

the scanning driver circuit is configured to, in the scanning time S for each frame, scan each pixel row in the display region; and the $N_2$ number of pixel rows in the second display region and scanning time S for each frame satisfies $$(k-0.1)\frac{S}{n} \le N_2 t \le (k+0.1)\frac{S}{n},$$

and $N_2$ t>0, where k is an integer greater than or equal to 0, and t is scanning time for the scanning driver circuit to scan one pixel row.

14. The display apparatus according to claim 13, wherein:

$N_2$ is an integer between 80 and 220.

15. The display apparatus according to claim 13, wherein:

the scanning time S for each frame includes display region scanning time, front porch time, and back porch time;

the display region scanning time for the N number of pixel rows is Nt;

the front porch time and the back porch time for M number of pixel rows are Mt; and S=t(N+M).

16. A driving method for an OLED display panel comprising:

a display region including N number of pixel rows; and a non-display region including a light-emitting driver circuit and a scanning driver circuit, wherein: the display region includes a first display region including $N_1$ number of pixel rows and a second display region including $N_2$ number of pixel rows, where $N_1$, $N_2$, and N are positive integers, and $N_1+N_2=N$; a pixel row in the second display region has a smaller number of pixels than a pixel row in the first display region; the light-emitting driver circuit is configured to, in scanning time S for each frame, supply a light-emitting control signal having n number of light-emitting cycles to each pixel row in the display region, where n is a positive integer; the scanning driver circuit is configured to, in the scanning time S for each frame, scan each pixel row in the display region; and the $N_2$ number of pixel rows in the second display region and scanning time S for each frame satisfies $$(k-0.1)\frac{S}{n} \le N_2 t \le (k+0.1)\frac{S}{n},$$

and $N_2$ t>0, where k is an integer greater than or equal to 0, and t is scanning time for the scanning driver circuit to scan one pixel row, wherein the driving method comprises:

in the scanning time S for each frame, supplying, by the light-emitting driver circuit, the light-emitting control signal having the n number of light-emitting cycles to each pixel row; and in the scanning time S for each frame, scanning, by the scanning driver circuit, each pixel row in the display region, wherein:

the $N_2$ number of pixel rows in the second display region and the scanning time S for each frame satisfies $$(k-0.1)\frac{S}{n} \le N_2 t \le (k+0.1)\frac{S}{n},$$

and $N_2$ t>0, where k is an integer greater than or equal to 0, and t is the scanning time for the scanning driver circuit to scan one pixel row.

17. The driving method according to claim 16, wherein:

$N_2$ is an integer between 80 and 220.

18. The driving method according to claim 16, wherein:

the scanning time S for each frame includes display region scanning time, front porch time, and back porch time;

the display region scanning time for the N number of pixel rows is Nt;

the front porch time and the back porch time for M number of pixel rows are Mt; and S=t(N+M).

19. The driving method according to claim 18, wherein:

$$N_2 = k\frac{(N+M)}{n}.$$

20. The driving method according to claim 18, wherein:

$$M = m\frac{(N+M)}{n},$$

where m is an integer greater than 0.

* * * * *